United States Patent [19]

Katzer

[11] B 3,995,724

[45] Dec. 7, 1976

[54] CENTERING DEVICE FOR A RAIL BRAKE MAGNET UNIT

[75] Inventor: Ernst Katzer, Munich, Germany

[73] Assignee: Knorr-Bremse GmbH, Munich, Germany

[22] Filed: Apr. 11, 1975

[21] Appl. No.: 567,435

[44] Published under the second Trial Voluntary Protest Program on February 3, 1976 as document No. B 567,435.

[30] Foreign Application Priority Data

Apr. 18, 1974 Germany ..... 2418636

[52] U.S. Cl. ..... 188/165; 105/77; 188/1 B; 308/3 R

[51] Int. Cl.[2] ..... F16D 65/34

[58] Field of Search ..... 188/1 B, 48, 165; 105/77, 78; 308/3 R

[56] References Cited

UNITED STATES PATENTS

| | | | |
|---|---|---|---|
| 567,951 | 9/1896 | Fairchild | 188/38 |
| 2,130,615 | 9/1938 | Crittenden | 188/165 |
| 2,150,630 | 3/1939 | Piron | 188/165 |
| 2,570,034 | 10/1951 | Larsen | 188/165 |
| 2,617,499 | 11/1952 | Jenkins et al. | 188/165 |
| 2,966,236 | 12/1960 | Jones | 188/165 |
| 3,723,795 | 3/1973 | Baermann | 188/165 |

FOREIGN PATENTS OR APPLICATIONS

| | | | |
|---|---|---|---|
| 302,788 | 10/1954 | Switzerland | 188/165 |

*Primary Examiner*—Trygve M. Blix
*Assistant Examiner*—Edward R. Kazenske
*Attorney, Agent, or Firm*—Edmund M. Jaskiewicz

[57] ABSTRACT

A rail brake magnet unit on a vehicle comprising separate rail brake magnets or a plurality of rail brake magnets connected together by a frame is vertically movable between a lowered operative position and a raised inoperative position. On approximately the four corners of the upper portion of the magnet unit there are provided inclined slide surfaces each of which engages a plane surface of a corresponding number of resilient buffers mounted on the vehicle structure when the rail brake magnet unit is in its raised inoperative position.

6 Claims, 4 Drawing Figures

CENTERING DEVICE FOR A RAIL BRAKE MAGNET UNIT

On vehicles provided with rail brake magnets it has been known to employ the magnets either as individual magnet units or a plurality of rail brake magnets interconnected by a frame to define a rail brake magnet assembly. Such an assembly is vertically displaceable into a lower operative position and a raised inoperative position by means of a suitable actuation device mounted between the magnet units and a vehicle structure which is generally a truck. The vehicle structure is usually provided with abutment or stop devices that are spaced on the magnet units of the vehicle structure so that when the magnet units are raised to their inoperative positions they are retained through reciprocal abutment action in a position which is fixed and centered with respect to the vehicle structure.

A plurality of separate magnets have been formed into a magnet unit or assembly by being interconnected by tie rods or other suitable structural elements. When a magnet unit is raised to its inoperative position various vibrations acting upon the mass of the unit during its vertical displacement produce transverse forces that in turn produce an undesirable oscillation or swinging of the magnet unit. Such vibrations and transverse forces should be absorbed by elements mounted on the vehicle structure. A group of such elements may comprise suspension and actuation devices as well as pivotable connections. As such elements must be protected as much as possible against relatively strong horizontal stresses it is necessary to provide structures that eliminate such undesirable transverse forces and oscillations.

In addition, should a magnet unit be deflected laterally when in its lowered inoperative position within the range of its provided play and tolerance, the unit must be moved into proper engagement with its abutment stops when it is raised from its operative to its inoperative position. The magnet unit should then be retained in its inoperative position by suitable devices which securely hold the unit with a minimum of wear.

The German printed specification DT-AS 1,903,315 discloses a suspension device which prevents the swinging or oscillation of a rail brake magnet when in its raised inoperative position. An abutment stop on the magnet element which transmits upwardly directed force to positions of the vehicle frame during raising of the magnet into the inoperative position has a conical surface which engages a corresponding conical abutment surface on the frame of the vehicle. The conical shape of the abutting annular surfaces securely positions that element of the rail brake magnet rigidly with respect to lateral displacement so that the raised magnet is not capable of oscillation in any direction. However, this structure is expensive and requires a precise centering of the abutment surfaces in all directions in order to produce the desired result.

The German Gebraunchsmuster No. 7,326,669 shows a suspension device of the general type described above comprising a centering pin mounted on either the vehicle structure or the magnet and a guide part having a centering bore arranged on the other side of the vehicle structure or the magnet. The centering pin has a conical top surface adjoining a cylindrical guide section having a diameter substantially equal to the diameter of the centering bore which then diverges into a conical section engageable with a corresponding conical surface on the guide element when the cylindrical guide portion of the pin is received within the centering bore of the guide element.

It is therefore the principal object of the present invention to provide a novel and improved centering device for a rail brake magnet unit on a vehicle.

It is another object of the present invention to provide such a centering device which is simple in structure, inexpensive to manufacture and install and reliable in operation.

It is a further object of the present invention to provide such a centering device which will retain the magnet assembly in a fixed and centered relationship with respect to the vehicle structure from which the magnet is suspended when the magnet is in its raised inoperative position.

According to one aspect of the present invention there may be provided a device on a vehicle structure for centering a rail brake magnet assembly comprising at least one rail brake magnet having four corners which are substantially rectangularly arranged on the upper portion thereof. Inclined slide surfaces are mounted on the corners of the magnet assembly with the surfaces being inclined from the vertical toward the sides of the vehicle structure. Opposed slide surfaces on opposite sides of an axis of the magnet unit are oppositely inclined. Four resilient buffers are mounted on the vehicle structure and each buffer has a plane surface engageable by a respective slide surface when the rail brake magnet assembly is in its raised inoperative position.

Other objects and advantages of the present invention will be apparent from the accompanying description when taken in conjunction with the following drawings, which are exemplary, wherein.

Proceeding next to the drawings wherein like reference symbols indicate the same parts throughout the various views a specific embodiment and modifications of the present invention will be described in detail.

Figure 1:
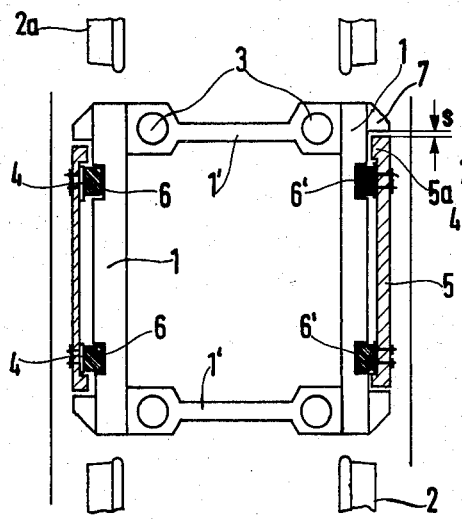
FIG. 1 is a plan view of a rail brake magnet unit provided with the centering device according to the present invention.

As may be seen in FIG. 1, two rail brake magnets 1 are interconnected by a pair of tie rods 1' to form a rail brake magnet assembly 1,1'. The magnet assembly 1,1' is positioned between wheel-axle sets 2 and **2*a* in a truck 5 of a railway vehicle that is not further illustrated nor described. The displacement of the magnet assembly 1,1' from its lower operative position into the raised inoperative position is accomplished in a known manner by means of four actuation cylinders 3 which need not be described in greater detail since they are known in the art. These actuation cylinders 3** may comprise spring-loaded and compressed air actuated cylinders as described in the German printed specification 1,903,315.

Resilient buffers 4 that may comprise rubber or a suitable rubber-like material are attached on the lateral sides of the frame of truck 5 by means of a bolted flange and are arranged in pairs on each side of the truck.

Slide surfaces 6 and 6' are mounted on each of the magnets 1 in positions opposing the buffers 4 so that the slide surfaces firmly engage the buffers when the magnet assembly 1,1' is raised into its inoperative position. The slide surfaces 6 and 6' are inclined from the vertical toward the side of the vehicle as may be seen in FIG. 4. Slide surfaces 6 or 6' located on the same side of the magnet assembly 1,1' are in each case parallel to each other in the longitudinal direction of the vehicle while slide surfaces 6 and 6' which are opposed from each other in the transverse direction of the vehicle are oppositely inclined.

Each of the buffers 4 is provided with a plane surface which is correspondingly inclined with respect to the slide surfaces 6 and 6' and contact the slide surfaces 6 and 6' in a planar relationship when the magnet assembly 1,1' is raised to its inoperative position so as to center the magnet assembly in the transverse direction. Thus, any forces resulting from transverse accelerations are absorbed and swinging or oscillating of the magnet assembly is prevented.

In order to prevent longitudinal oscillation or swinging of the magnet assembly there are provided at the ends of the outer faces of the magnet assembly 1,1' abutments 7 which are opposed with a certain predetermined clearance *s* from abutments 5*a* on the truck frame 5. The stops 7 will be effective only on the occurrence of relatively strong longitudinal forces that would overcome the friction between the rubber buffers 4 and slide surfaces 6,6'.

Figure 2:
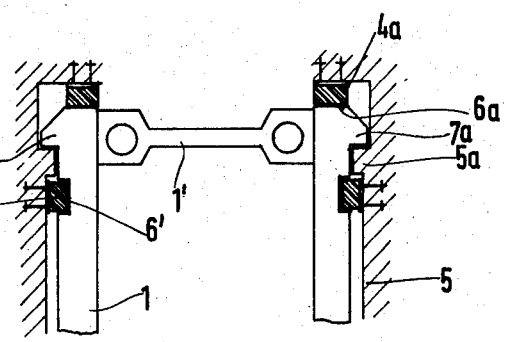
FIGS. 2 and 3 are portions of the plan view of FIG. 1 and show further modifications of the present invention.

In the modification of FIG. 2, additional rubber buffers 4*a* and slide surfaces 6*a* which are pivoted by 90° with respect to the lateral slide surfaces 6 and buffers 4 are mounted on the ends of the magnet assembly 1,1'. This modification will function similarly to the structure of FIG. 1 but eliminates the necessity for providing a clearance *s* when the magnet assembly is in its raised position.

Further, metal cam stops 5*a* are provided on the truck 5 to engage corresponding stops 7*a* on the magnet assembly when the magnet assembly is not in its raised position and when the magnet assembly is subjected to longitudinal oscillatory movement.

Figure 3:
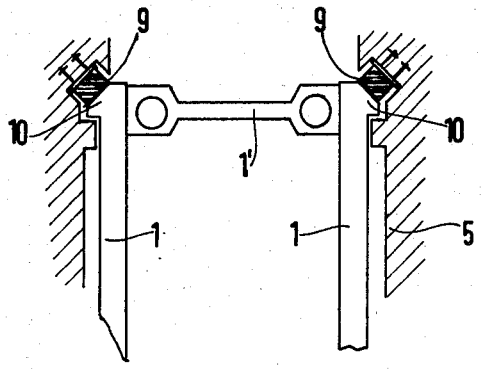

In the modification of FIG. 3, a rubber buffer 9 is also provided on the four corners of the space provided on the truck 5 for the magnet assembly. The transverse axis of each buffer 9 is positioned approximately in a vertical plane passing through the diagonal of the space in the truck 4 for the magnet assembly and each buffer engages corresponding slide surfaces 10 mounted on the magnet assembly. The slide surfaces 10 are inclined downwardly on the corners of the magnet assembly such that each slide surface has a horizontal straight line passing therethrough which is substantially perpendicular to the respective diagonals of magnet assembly 1,1'. In this modification, both the transverse and longitudinal forces are effectively absorbed by rubber buffers, similar to the results achieved in the structure of FIG. 2. However, the modification of FIG. 3 requires only four buffers to perform this function.

Figure 4:
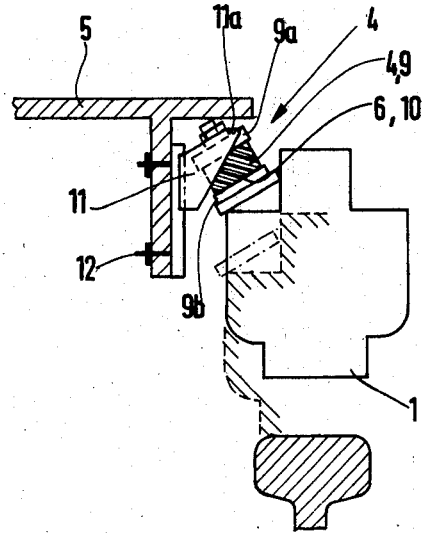
FIG. 4 is an elevational view of a rail brake magnet and centering device according to the present invention.

The relative position and construction of the rubber buffers and slide surfaces are shown in greater detail in FIG. 4. A flange 11 is attached to truck frame 5 by bolts or screws 12. The flange 11 has an extension 11*a* that extends perpendicularly to the longitudinal direction of the rubber buffer 4 or 9. The rubber buffer 4 or 9 is attached to each said extension 11*a* such as by a screw. Each rubber buffer is reinforced on both its upper and lower surfaces with sheet metal plates such as 9*a* and 9*b*. The reinforcing plate 9*b* engages a slide surface 6 that is mounted on the brake magnet 1 inclined with respect to the inclination of the reinforcing plate 9*b*.

In its lowered operative position, the magnet assembly has in its longitudinal direction a clearance 2*s* with respect to truck 5 and this clearance is about 10–18 mm. There is also some play in the transverse direction. When the magnet assembly 1,1' is raised from its lower operative position into the upper inoperative position the slide surface 6 readily contacts reinforcing plate 9*b* and slides along this plate until the raised inoperative position is achieved. The magnet assembly 1,1' is thus centered when the inclined slide surfaces 9 or 10 are in planar engagement with the lower surfaces of the buffers 4 or 9. In the raised inoperative position, the magnet assembly 1,1' is secured free of any play with respect to the truck 5 by means of the abutting slide surfaces and buffers.

It is to be noted that in FIG. 1 the opposed slide plates 6 and 6' which are on opposite sides of the longitudinal axis of the magnet assembly 1,1' are oppositely inclined with respect to each other. Similarly, in FIG. 2, the opposed slide plates 6*a* which are on different sides of the transverse axis of the magnet assembly 1,1' are oppositely inclined. Also, the slide plates 10 on the corners of the magnet assembly 1,1' of FIG. 3 which are on opposite corners of the magnet assembly are oppositely inclined.

It is thus apparent that utilizing the arrangement of slide surfaces on a magnet assembly engageable with resilient buffers on a vehicle structure as provided in the present invention will retain the rail brake magnet assembly in a fixed and centered position with respect to the vehicle structure when the magnet assembly is in its raised inoperative position.

It will be understood that this invention is susceptible to modification in order to adapt it to different usages and conditions, and accordingly, it is desired to comprehend such modifications within this invention as may fall within the scope of appended claims.

What is claimed is:

1. A device on a vehicle structure for centering a rail brake magnet assembly comprising at least one rail brake magnet having four corners substantially rectangularly arranged on the upper portion thereof and vertically movable between a lowered operative position and a raised inoperative position, comprising means on each of the four corners for defining a slide surface thereon, each of said slide surfaces being inclined from the vertical downwardly toward a side of the magnet assembly such that transversely opposed slide surfaces on different sides of an axis of the magnet assembly are oppositely inclined, and four resilient buffers mounted on the vehicle structure and each having a plane surface engageable by said slide surfaces respectively when the rail brake magnet assembly is in its raised inoperative position to retain the magnet assembly in a fixed and centered position with respect to the said vehicle structure.

2. A device as claimed in claim 1 wherein longitudinally spaced slide surfaces are inclined in the same direction.

3. A device as claimed in claim 1 wherein the slide surfaces on the same side of the magnet assembly are disposed in a horizontal plane having a straight line therethrough parallel to the longitudinal direction of the vehicle.

4. A device as claimed in claim 1 and comprising at least two additional slide surface means on said magnet assembly inclined from the vertical in the longitudinal direction of the vehicle, and at least two corresponding buffers on the vehicle engageable by said two additional slide surfaces when the magnet assembly is in its raised inoperative position.

5. A device as claimed in claim 4 wherein there are four of said additional slide surfaces and longitudinally spaced slide surfaces being oppositely inclined to each other.

6. A device as claimed in claim 1 wherein said slide surfaces are disposed obliquely to the longitudinal and transverse directions of the vehicle structure and have horizontal straight lines passing therethrough that are substantially perpendicular to the diagonals of the magnet assembly.

* * * * *